United States Patent [19]

Bradley

[11] 4,064,695

[45] Dec. 27, 1977

[54] STARTER/BLOWER MOTOR

[75] Inventor: John E. Bradley, Inkster, Mich.

[73] Assignee: Ford Motor Company, Dearborn, Mich.

[21] Appl. No.: 753,346

[22] Filed: Dec. 22, 1976

[51] Int. Cl.[2] ..... F02G 1/04

[52] U.S. Cl. ..... 60/517; 60/656

[58] Field of Search ..... 60/656, 517, 525, 526

[56] References Cited

U.S. PATENT DOCUMENTS 4,020,634 5/1977 Bradley ..... 60/517

*Primary Examiner*—Allen M. Ostrager

*Attorney, Agent, or Firm*—Joseph W. Malleck; Keith L. Zerschling

[57] ABSTRACT

A Stirling engine is disclosed having an auxiliary drive system employing only one independent motor for providing both initial air compressor operation during engine warm-up and engine cranking. The auxiliary drive system has an electromagnetic clutch and a phased gear coupling actuated in sequence to promote drive for cranking the engine only after the engine has reached a certain operating temperature through use of an air compressor driven by said motor.

4 Claims, 4 Drawing Figures

STARTER/BLOWER MOTOR

BACKGROUND OF THE INVENTION

No other vehiclar engine, other than a Stirlingtype power plant, requires both a crank motor and blower motor for starting a cold engine. Both motors demand an auxiliary power source and the cold engine does not produce sufficient power output to energize the blower until a stable level of operating conditions is achieved. The requirement for separate and distinct motors has proved to be a disadvantage since both must be arranged separately and each constitute a duplication in weight and structure for the engine and promote an additional drain upon the engine battery. Space limitations imposed on automotive engine packaging are difficult to meet with the use of two separate motors.

The motors, when operated, overlap during their time of functioning. For example, a typical starting sequence for a Stirling engine comprises (a) starting the blower motor (by using an auxiliary power source) to clear the system of residual gases, (b) after an interval of four seconds, fuel and spark are injected into the system, (c) after an operating temperature of 600° C is sensed in the heater chamber, the crank motor is started by an auxiliary power source, (d) after 400 r.p.m. is achieved by the output number of the engine, the crank motor is cut out, and (e) after an operating temperature of about 675° C is obtained in the heater chamber, the blower motor is cut out with the blower being driven directly by the engine. It can be appreciated that between the temperatures of 600°–675° C both motors may be functioning if the engine r.p.m. is under 400. The control for the crank motor requires both predetermined levels of temperature and speed to permit cut out; below such levels, frictional drag and inertia are too great to be overcome by the engine to sustain motion. The overlapping functioning of such motors usually requires the incorporation of transmission systems and overrunning devices to eliminate interference therebetween.

SUMMARY OF THE INVENTION

A primary object of this invention is to provide an improved Stirling engine which is less costly and lower in weight to better meet the requirements of automotive applications.

Another object of this invention is to provide a Stirling engine of the regenerative thermodynamic type having a closed working fluid system, the engine being capable of fitting within a reduced package space demanded by smaller volume requirements of lighter weight vehicle applications.

Another object of this invention is to provide a Stirling engine which imposes a reduced demand on the engine battery.

Another object is to provide a Stirling engine which employs a single motor to do the job of two motors heretofore, said single motor permitting single or double power take-off in sequential or simultaneous manner.

Yet still another object of this invention is to provide a Stirling engine employing a dual drive system with multiple power take-offs, one of said take-offs employing a staged coupling to sequentially initiate gear engagement and subsequently a full power coupling.

Features pursuant to the above objects comprise: (a) the integration of the two motors into one, the resultant motor being mounted at a lower rear position of the engine assemblage, the housing of the single motor being substantially aligned within the elevational envelope of the ring gear housing, the ring gear interconnecting the output shaft of the engine with the engine transmission, (b) the use of a twostage electro-magnetic clutch between one end of the motor shaft and the engine to permit both gear engagement and full power coupling for cranking purposes, and (c) maintaining the other end of the motor shaft continuously connected for blower drive.

SUMMARY OF THE DRAWINGS

FIG. 3 is an enlarged elevational view, partly in section, of the dual drive system for a Stirling engine, embodying the principals herein.

DETAILED DESCRIPTION

Figure 1:
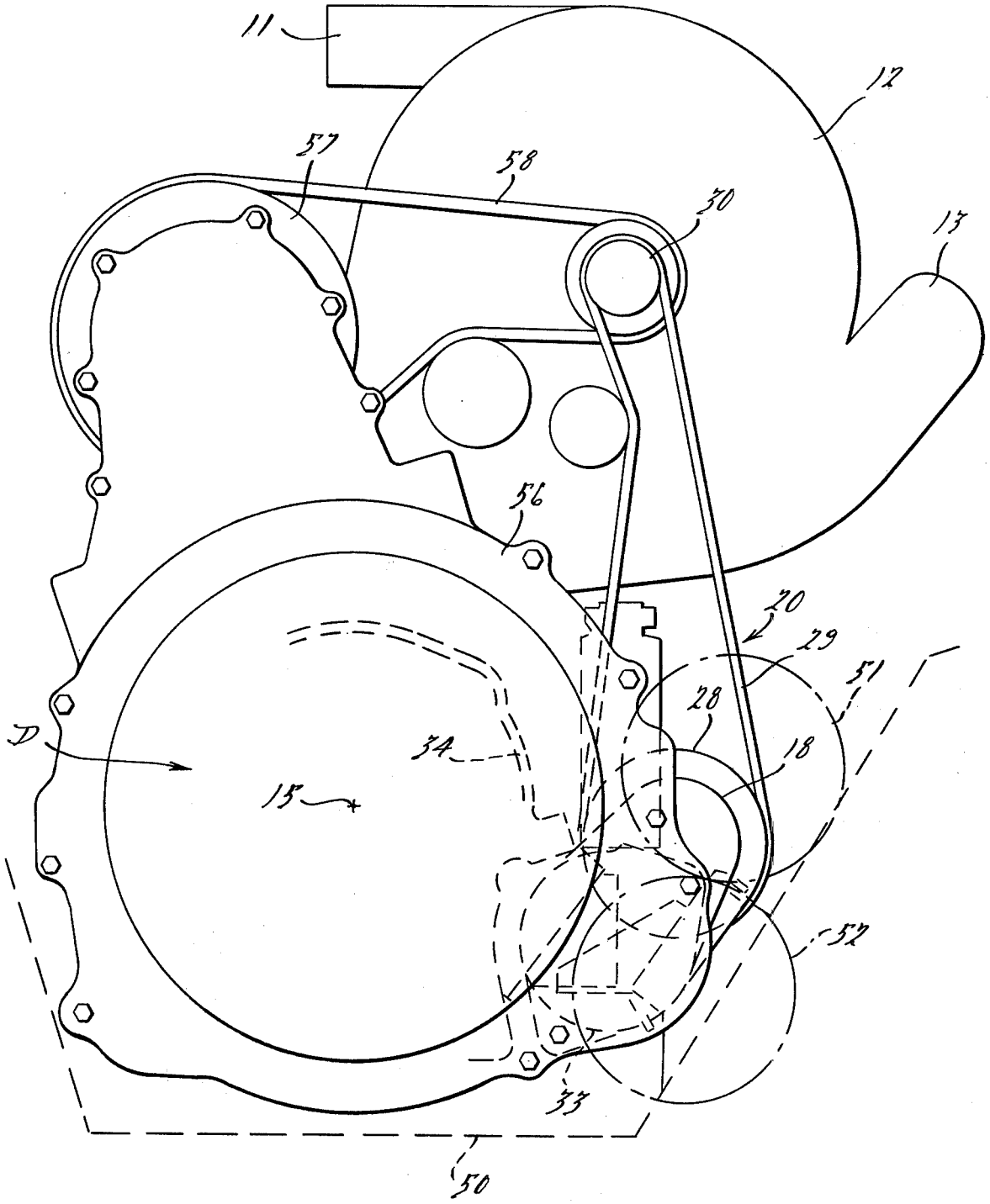
FIG. 1 is a rear elevational view of a substantial part of a Stirling-type engine showing in outline the general location of the major parts of the engine; superimposed is the image of the single motor of the present invention and its accompanying power transfer drive, the broken outline representing the desired confined location of the engine components, which location cannot be observed by prior art motors shown in phantom line.
Figure 2:
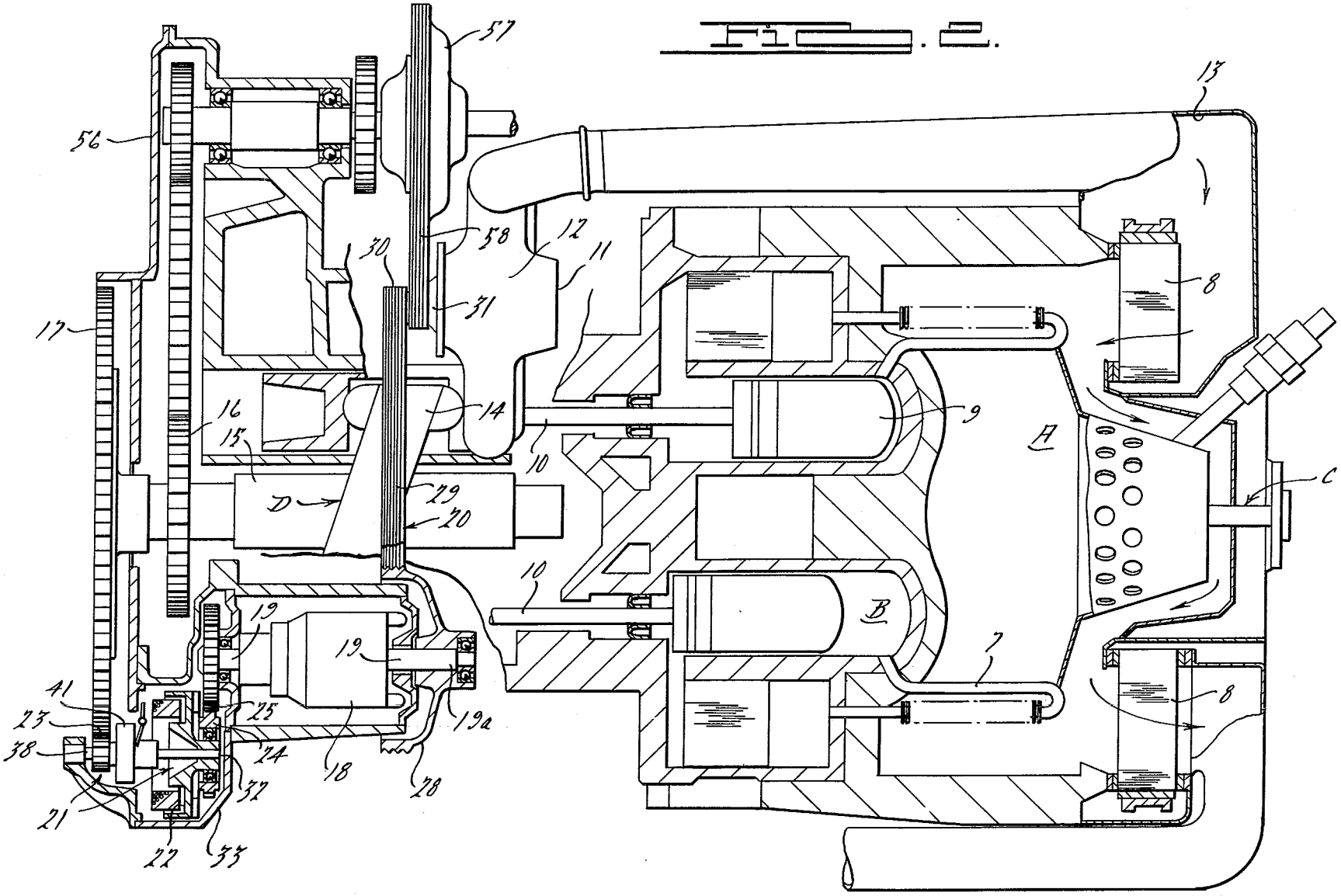
FIG. 2 is a side elevational view of a portion of the structure of FIG. 1.
Figures 2, 4:
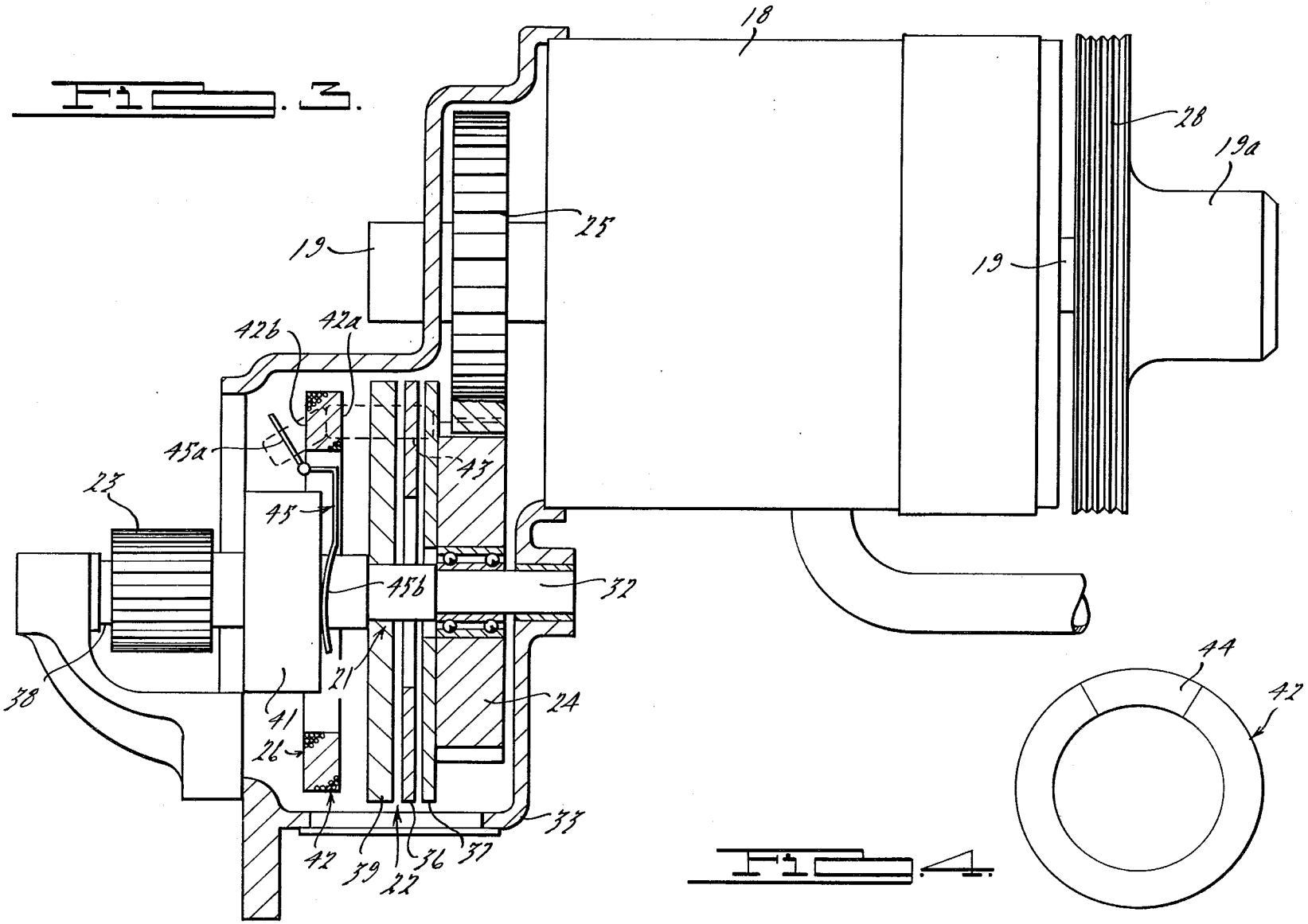
FIG. 4 is an elevational view of the flux plate used in the construction of FIG. 3.

The embodiment illustrated in FIGS. 1–3 particularly achieves the objects of space reduction for the engine assembly, weight and cost reduction, and reduced current draw on the engine battery or electrical source. The Stirling engine illustrated in said figures, is of the type generally disclosed in copending U.S. Application Ser. No. 684,704, commonly assigned to the assignee herein, which disclosure is incorporated herein by reference. Such engine employs an external combustion circuit A, a closed internal working system B, a fuel system C for supplying the external combustion circuit A with a combustible mixture. The closed internal working system B includes a plurality of double-acting pistons 9 arranged in series and adapted to respond to the regenerative thermal cycling of the gases within the closed working system B. The drive system D is responsive to the regenerative thermal cycling of the pistons by way of piston rods 10 connected to the doublt-acting pistons.

The external working circuit A of a Stirling engine of this type normally comprises an air intake 11 leading to a compressor 12 (or blower) for increasing air flow into a delivery passage 13 from the compressor. The air is passed from said delivery passage through a preheater wheel device 8 and finally into a combustion unit forming part of the circuit A. The products of such combustion unit pass about a tube array 7, constituting part of the closed working fluid system for heat exchange. The combusted gas thence exits through the preheater and out through an exhaust passage. The fuel and ignition systems, normally incorporated as part of the external heating circuit, ignite and combust the mixture continuously.

The drive system D particularly comprises reciprocally driven elements, such as the rods 10 connected to the double-acting pistons. Each of the rods are in turn connected to a rotary converter 14, preferably in the form of a swash plate particularly detailed in said U.S.

application Ser. No. 684,704. The swash plate is drivingly connected to an output shaft 15 which carried at one end thereof suitably driven concentric gears 16 and 17.

An auxiliary drive system E is effective to interconnect an electric motor 18 either with gear 17 (and thereby output shaft 15 of said engine) and/or with the compressor 12 of said external circuit A. The drive system E comprises a motor shaft 19 which extends entirely through said electric motor 18 forming the central longitudinal axis thereof, a means 20 drivingly connecting the motor shaft 19 to the compressor 12, and means 21 to connect said motor shaft 19 to the output shaft 15 of the engine drive system. Interposed within the means 21 which drivingly connects the motor shaft 19 to the output shaft of the engine 15, is a gradually engagable friction coupling 22 which receives drive from the motor by spur gear 24 and sun gear 25 combination. An axially interengagable gear 23 is effective to complete the drive connection from said friction coupling to the gear 17. An actuator means 26 is employed for engaging either of said friction coupling 22 or axially engagable gear 23.

In some particularity, the means 20 comprises a pulley wheel 28 mounted at one end 19*a* of the motor shaft; a driving connection to said compressor is provided by a pulley 29 mounted between said wheel 28 and the smaller stepped pulley wheel 30 on the compressor shaft 31.

At the opposite end of the motor shaft 15 is the concentric sun gear 25 which is constantly meshed with spur gear 24 mounted on a pinion shaft 32 carried in a housing 33 fitted to and supported by the housing 34 of the drive system D for the engine. A chain drive system is enclosed within a cover 56 attached to housing 34, the chain drive system taking power from the output shaft 15 when the engine is fully operational and drives various elements, such as the compressor 12 through a viscous clutch 57 and pulley 58.

As shown in FIG. 3, the coupling 22 includes a pair of annular friction rings 36–37, one of which (37) is drivingly connected to the spur gear 24 and the other (36) is axially slidable on but drivingly connected to the pinion shaft 32 coaxial with a coupling shaft 38. A pressure plate 39 is mounted for axial movement of the pinion shaft 32 and is adapted to be moved into engagement with said friction rings by actuator means 26 to provide a gradual coupling therebetween.

The axially interengagable gear 23 for completing the connection to the shaft 15 comprises a small sun gear mounted for axial movement on coupling shaft 38 and has an overrunning collar 41 integral therewith for axial movement and to prevent gear 17 from driving gear 23. The gear 23 is adapted for selective intermeshing with gear 17 of the output shaft.

The actuator means 26 comprises an electromagnetic armature ring 42 which contains on one face 42*a* thereof suitable windings for stimulating a flux path 43 which interweaves through said pressure plate to promote interengagement between said friction rings. Said electromagnetic coupling acts in the manner of a normal electromagnetic clutch. One segment 44 of said armature ring on the opposite side 42*b* thereof is provided with a separate winding, said latter winding is adapted to electromagnetically actuate one end 45*a* of a metallic lever 45 responsive to a magnetic field. One end 45*b* of said lever is adapted to move the collar 41 of said sun gear 23 so as to promote interengagement of said gears.

In operation, drive system E is effective to promote starting of a cold engine and do so by engine apparatus occupying less space. As shown in FIG. 1, the normal envelope into which an engine is to be in commercial passenger vehicles comprises a trough space 50 indicated in broken outline. By use of the prior art, requiring two separate independent motors 51 and 52 (phantom outline) mounted closely adjacent the engine drive systems, such envelope has been extremely difficult to meet, if not impossible. However, with the use of the single motor 18 and drive system E, the venvlope criteria can be met as viewed in FIG. 1, thereby resulting in weight and cost savings.

Upon start up of the engine by the operator, the motor 18 is energized, causing pulley means 20 to turn and directly drive the compressor 12. During this condition of operation, air is supplied by the compressor 12 to purge the passages of the external heating circuit A and provide air for combustion during engine warm up. During this period of time, the gear 25 at the other end of the motor drive shaft 19 is in engagement with gear 24, but a driving connection to the output member 15 of the engine is not complete because of the disengagement of the coupling 22 and thus unable to crank the engine. After the period of time, about four seconds, fuel and spark is added to the combustion unit of circuit. A whereby engine temperature begins to rise within the heater passages. At a time when the heater passage temperature reaches 600° C, as signalled by a thermal device 54, electrical source 55 too is placed in connection (by way of switch 56) with the armature 26 of said friction coupling to sequentially actuate the windings thereof. Initially only the upper segment 44 is energized whereby the lever 45 is moved to cause said gear 23 to slide and engage the gear 17 thereby connecting with the output shaft 15 of the engine. After a predetermined time delay has expired during which said gear 23 is meshed completely, the remaining winding of the armature 26 is energized to complete a drive connection through coupling 22 whereby rings 36–37 are pressed together for conjoint rotation.

I claim:

1. A drive system for a Stirling engine having an external heating circuit with a compressor for injecting air thereinto, and a thermodynamic cycling system for converting energy derived from said heating circuit into mechanical motion and for extracting work energy by way of a driven output means, said drive system comprising:

a. a motor driven independently of said engine and having a driven shaft, b. means drivingly connecting said driven shaft to the compressor for a period of time during which the engine is started from a cold condition, c. means selectively connecting said driven shaft to said driven output means for driving the latter during only an intermediate portion of said period during which the engine is started from a cold condition, said selectively connecting means having intermeshable gear elements relatively movable for interrupting the selectively connecting means, said selectively collecting means having a gradually engagable friction coupling for interrupting drive through said selectively connecting means, and said selectively connecting means further having an actuator effective to sequentially first establish intermeshing of said gear elements and secondly establish drive engagement through said friction coupling.

2. A drive system as in claim 1 which further comprises a control for said actuator to initiate said sequential establishment of intermeshing and coupling interengagement upon said thermal cycling system reaching a predetermined temperature, said control being effective to de-energize said actuator upon reaching both a predetermined speed of said output means and a predetermined temperature of said thermal cycling system.

3. A drive system as in claim 1, in which said actuator comprises magnetically permeable pressure rings, one of said rings being fixed against axial movement and the other being movable for axial movement, friction means interposed between said pressure rings and an armature ring effective to induce a flux path through said magnetically permeable pressure rings for establishing conjoint rotation between said rings, one of said rings being drivingly connected to said motor and the other of said rings being drivingly connected to said output means.

4. The starter system as in claim 3, in which said intermeshable gear elements are interposed between the driving connection between said one element and said driven means, at least one of said intermeshable gear elements be axially slidable, and said selectively connecting means having a pivotable lever actuated by said armature ring for promoting said intermeshing.

* * * * *